US005214435A

United States Patent [19]

Lopez

[11] Patent Number: 5,214,435

[45] Date of Patent: May 25, 1993

[54] NEAR FIELD MONITOR FOR A MICROWAVE LANDING SYSTEM

[76] Inventor: Alfred R. Lopez, Four Sarina Dr., Commack, N.Y. 11725

[21] Appl. No.: 878,380

[22] Filed: May 4, 1992

Related U.S. Application Data

[63] Continuation-in-part of Ser. No. 591,698, Oct. 2, 1990, abandoned.

[51] Int. Cl.[5] ..... H01Q 3/00

[52] U.S. Cl. ..... 342/360

[58] Field of Search ..... 342/360, 173

[56] References Cited

U.S. PATENT DOCUMENTS 4,926,186 5/1990 Kelly et al. ..... 342/360

*Primary Examiner*—Theodore M. Blum

*Attorney, Agent, or Firm*—Darby & Darby

[57] ABSTRACT

A microwave landing system, i.e. MLS, monitor utilizes phase conjugate digital signal processing of near field signals in order to provide an accurate estimate of the signal in the far field. Because of the use of phase conjugate processing, this near field monitor can be located close to the MLS antenna without significant error. This is possible because of the unique relationship of the MLS signal modulation frequencies and the near field geometry.

11 Claims, 8 Drawing Sheets

FIG. 6

| m | $WI_m$ | $WQ_m$ | m | $WI_m$ | $WQ_m$ |
|---|---|---|---|---|---|
| 1.00 | -5.31 | -2.51 | 33.00 | 24.55 | 23.79 |
| 2.00 | 6.04 | 2.63 | 34.00 | 27.63 | 20.55 |
| 3.00 | -6.98 | -2.71 | 35.00 | 31.50 | 12.62 |
| 4.00 | 8.20 | 2.66 | 36.00 | 34.64 | 0.06 |
| 5.00 | -9.79 | -2.38 | 37.00 | 29.20 | -17.32 |
| 6.00 | 11.82 | 1.64 | 38.00 | 14.13 | -31.12 |
| 7.00 | -14.29 | -0.06 | 39.00 | -13.12 | -32.37 |
| 8.00 | 17.00 | -2.88 | 40.00 | -31.82 | -9.58 |
| 9.00 | -19.29 | 7.87 | 41.00 | -26.51 | 22.33 |
| 10.00 | 19.73 | -15.36 | 42.00 | 12.12 | 33.14 |
| 11.00 | -16.02 | 24.82 | 43.00 | 32.79 | -2.22 |
| 12.00 | 5.60 | -33.50 | 44.00 | 5.38 | -33.17 |
| 13.00 | 11.96 | 35.52 | 45.00 | -35.84 | -5.49 |
| 14.00 | -31.00 | -23.87 | 46.00 | 1.29 | 35.33 |
| 15.00 | 38.05 | -2.38 | 47.00 | 30.98 | -8.35 |
| 16.00 | -19.96 | 28.47 | 48.00 | -15.66 | -27.40 |
| 17.00 | -15.66 | -27.40 | 49.00 | -19.96 | 28.47 |
| 18.00 | 30.98 | -8.35 | 50.00 | 38.05 | -2.38 |
| 19.00 | 1.29 | 35.33 | 51.00 | -31.00 | -23.87 |
| 20.00 | -35.84 | -5.49 | 52.00 | 11.96 | 35.52 |
| 21.00 | 5.38 | -33.17 | 53.00 | 5.60 | -33.50 |
| 22.00 | 32.79 | -2.22 | 54.00 | -16.02 | 24.82 |
| 23.00 | 12.12 | 33.14 | 55.00 | 19.73 | -15.36 |
| 24.00 | -26.51 | 22.33 | 56.00 | -19.29 | 7.87 |
| 25.00 | -31.82 | -9.58 | 57.00 | 17.00 | -2.88 |
| 26.00 | -13.12 | -32.37 | 58.00 | -14.29 | -0.06 |
| 27.00 | 14.13 | -31.12 | 59.00 | 11.82 | 1.64 |
| 28.00 | 29.20 | -17.32 | 60.00 | -9.79 | -2.38 |
| 29.00 | 34.64 | 0.06 | 61.00 | 8.20 | 2.66 |
| 30.00 | 31.50 | 12.62 | 62.00 | -6.98 | -2.71 |
| 31.00 | 27.63 | 20.55 | 63.00 | 6.04 | 2.63 |
| 32.00 | 24.55 | 23.79 | 64.00 | -5.31 | -2.51 |

NEAR FIELD MONITOR FOR A MICROWAVE LANDING SYSTEM

This is a continuation-in-part of U.S. patent application Ser. No. 07/591,698 of Feldman, et al. filed Oct. 2, 1990 now abandoned.

BACKGROUND OF THE INVENTION

The present invention relates to near field antenna measurement systems generally and, more particularly, to near field measurement systems that allow the signal from a monitoring antenna in the near field to be processed so that it approximates a signal that would be received if the monitoring antenna were located in the far field.

While the present invention is described in connection with near field antenna monitors for microwave landing systems (MLS) for aircraft, it will be understood by those skilled in the art that it has other useful applications as well.

In part an MLS is concerned with angle guidance for aircraft, which is accomplished through the use of two electronically scanned microwave antenna arrays—one for azimuth and the other for elevation. Such an MLS system is described in U.S. Pat. No. 3,999,182 of Moeller et al. This system uses an antenna made up of a plurality of radiating elements spaced along a linear axis to the left and right of a center element. Each element on the left and right is fed r.f. energy from a common feed line through individual electronically variable phase shifters. In order to produce a specific radiation pattern, e.g. a beam focused at a remote point, each element receives a precisely determined portion of the power from the feed line with a particular phase. By varying the phase electronically with the phase shifters, the beam can be made to scan TO and FRO at a particular rate.

Since this system is critical for aircraft safety, each antenna is continuously monitored in the field in real time to assess the quality of the guidance angle data. The critical monitored parameter is the time between the centers of the TO and FRO beams, which is the guidance angle information. Preferably, the beam is monitored in the far field, i.e. at the distance from the antenna where the beam is focused. This distance from the antenna is at least $2D^2/\lambda$, wherein D=the aperture size or width of the antenna ray and $\lambda$=the wavelength of the transmitted signal, all in feet. For a 1 degree beam width antenna, this distance is approximately 1400 feet.

U.S. Pat. No. 4,926,186 of Kelly et al. described a scanning phased array monitor which uses a single receiver located in the far field at an angle to the main axis of the antenna or an integral waveguide monitor fixed to the antenna. In the Kelly type arrangement, far field signals from the monitor are converted into in-phase, I, and quadrature phase, Q, signals that are detected and sampled at non-uniform intervals. These samples are processed according to Fast Fourier Transforms to determine the amplitude and phase of the phase shifter outputs. The output signals are compared to reference values. Any deviation from the reference values indicates which element of the antenna array is malfunctioning. This monitor, however, is not a guidance angle monitor.

In many cases, it is impractical to locate guidance angle monitors in the far field. For example, in the area from the antenna to a point 1400 feet away there may be physical obstructions, e.g. buildings and airport traffic, that will disturb the beam. Also, there may be radio frequency interference sources, such as radio signals from taxiing aircraft.

Locating the monitor in the near field where the transmitted beam is unfocused can also result in unacceptable performance, primarily due to systematic phase variation which is related to the path difference variation of the individual array elements to a field monitor antenna in the near field. While somewhat acceptable results can be obtained with monitors located about 240 feet from the antenna (i.e. $\frac{1}{3} D^2/\lambda$, there is considerable room for improvement.

The approach of making antenna measurements in the near field also results in significant degradation in system integrity and continuity of service, which are critical requirements for zero visibility landing capability specified by FAA regulations. The integrity is diminished because monitoring accuracy is degraded due to defocusing of the beam at that distance. In particular, some angle guidance errors go undetected by the monitor in the near field, e.g., a 90° phase error at close range may look like a 180° phase error and cause no monitor error, while the actual radiated signal-in-space has an error.

Continuity is lost because, in some cases, the MLS signals is within tolerance limits, but the monitor may indicate that it is outside the tolerance limits. In effect the near field monitor may cause false alarms when certain antenna components fail. The transmitting ground equipment is designed to operate with a specified number of component failures so as to increase the continuity of system service. However, with the antenna in the near field the loss of an element in the phased array may cause an out-of-tolerance monitor error. As a result the system will automatically shut down. Thus, there are unnecessary interruptions in service. Also, in some cases, even a distance of 240 feet is impractical and it would be desirable to be able to locate the monitor closer, say perhaps as close as 80–90 feet, and still be able to obtain acceptable results.

Integral monitors as mentioned in the Kelly et al. patent are fixed to the array. As a result, if there is mechanical motion of the array or there is ice or snow on the radome which affects the angle guidance signal, the integral monitor will not detect it. The field monitor is sensitive to all effects, including mechanical motion and radome effects.

In copending U.S. application Ser. No. 07/591,698 of Feldman et al., there is described a near field monitor that achieves acceptable monitoring of the performance of an antenna ray. According to this application a monitor, in the form of one receiving antenna, is located between 80 and 90 feet from the antenna. The signals from the receiving antenna are processed in terms of amplitude and phase, and are combined so that the signal aproximates that which would be received if it were in the far field. In particular the signals are resolved into a series of I and Q samples which are stored in a buffer memory. A subset of these stored samples is multiplied by separate weighing factors and then combined according to $$A = \sqrt{I^2 + Q^2}$$

where

-continued $$I = \sum_{m=1}^{M} I_m \times WI_m \text{ and } Q = \sum_{m=1}^{M} Q_m \times WQ_m$$

and where $WI_m$, $WQ_m$ are the weighing factors for the $I_m$ and $Q_m$ components, respectively and M is the total number of weights. The process is a Finite Impulse Response (FIR) digital filter process.

SUMMARY OF THE INVENTION

The present invention is directed to a field monitoring antenna positioned in the near field and processing the signal received by that monitoring antenna from an MLS antenna so that it accurately approximates the signal it would have received if it were located in the far field. In effect, the signal received by the near field monitoring antenna is passed through a signal processor having the necessary characteristics to construct a signal corresponding to that which would have been received in the far field.

In accordance with an illustrative embodiment of the present invention there is provided an antenna measurement system providing "phase conjugate" processing of near field signals for evaluation of MLS antenna performance. The phase shift in the signal received in the near field is phase shifted by an ideal constant amplitude filter with a conjugate phase shift, in order to make the resulting signal appear in the form it would have at the far field. In particular, the monitoring antenna is located within about 100 feet of the azimuth and/or elevation antenna of an MLS system. The signal received by the monitoring antenna is response to the MLS antenna is applied to a signal processor. In this processor the signal is separated in to in-phase, I, and quadrature, Q, components, e.g. by a homodyne detector. The analog, I, Q signals are sampled and converted into digital signals that are temporarily stored in a buffer memory. The components (i.e. I, Q samples) are multiplied by weighing factors WI, WQ related to the Fourier Transform of an ideal constant amplitude-conjugate phase filter and are accumulated. Then the direct and cross product terms, $I_1$, $I_2$ and $Q_1$, $Q_2$, are combined according to $$A = \sqrt{(I_1 - Q_2)^2 + (I_2 + Q_1)^2}$$

where $$I_1 = \sum_{m=1}^{M} I_m \times WI_m \; I_2 = \sum_{m=1}^{M} I_m \times WQ_m$$

$$Q_1 = \sum_{m=1}^{M} Q_m \times WI_m \; Q_2 = \sum_{m=1}^{M} Q_m \times WQ_m$$

The result is a signal that closely approximates the far field, signal even for a spacing of the monitor antenna from the MLS antenna at $(\frac{1}{8})\ D^2/\lambda$ or 90 feet, but is generated by a near field monitoring antenna.

BRIEF DESCRIPTION OF THE DRAWINGS

The foregoing and other features of the present invention will be more readily apparent from the following detailed description and drawings of illustrative embodiments of the invention in which:

FIG. 6 shows a specific set of weighing functions according to the present invention; and FIG. 7 shows the results of computer simulations which illustrate the performance improvement of the present invention over the prior embodiment. In particular

DESCRIPTION OF ILLUSTRATIVE EMBODIMENTS

Figure 1:
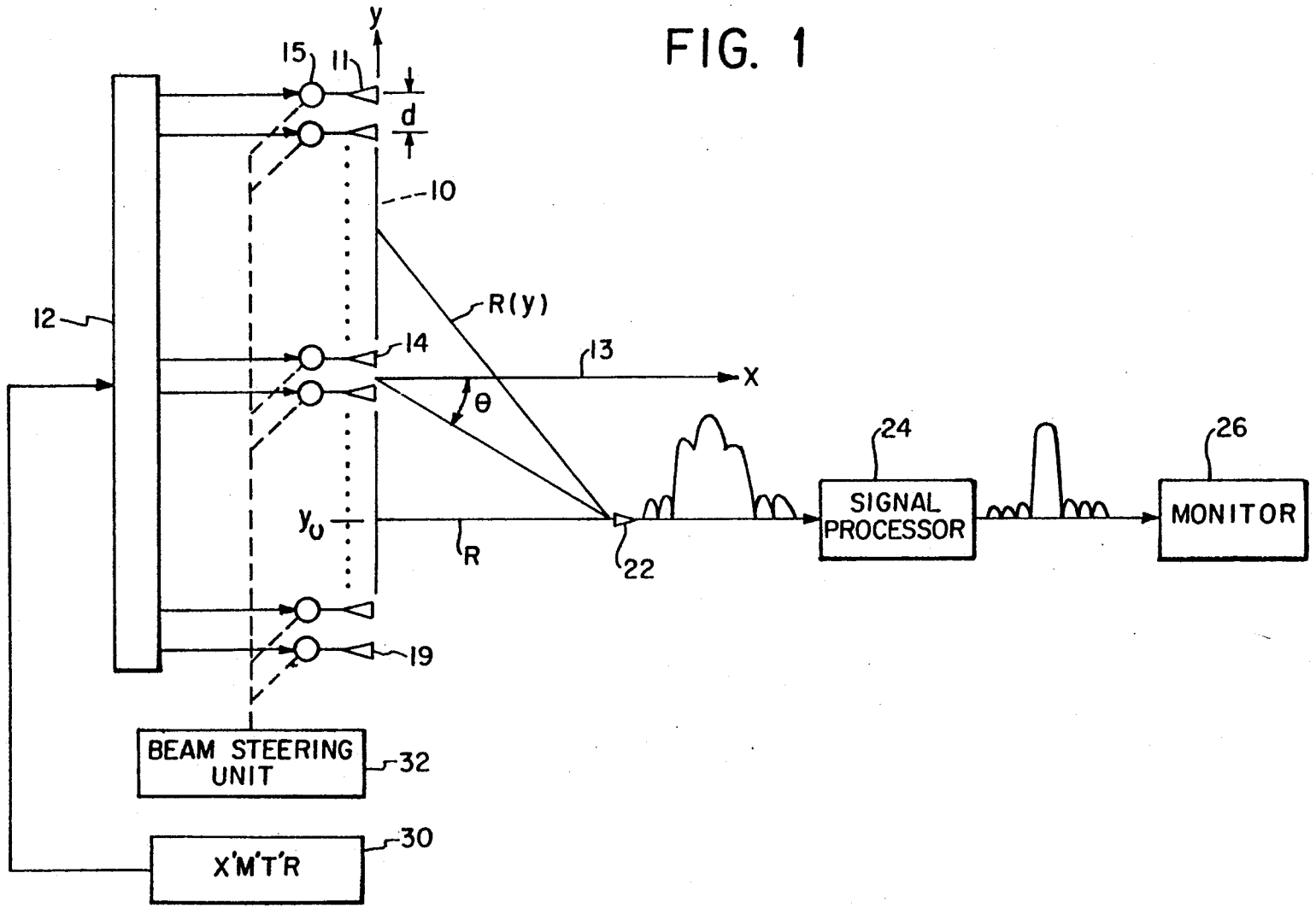
FIG. 1 is a block diagram of a field monitor system according to an embodiment of the present invention.

FIG. 1 illustrates a phased array antenna system 10 which may be utilized as the azimuth or elevation antennas of a microwave landing system MLS or a similar application. The scanning beam from antenna 10 is analyzed by a monitoring system 20 that includes a monitoring antenna 22, a signal processor 24 and a monitor device 26.

The phased array antenna 10 is represented schematically as comprising N linearly disposed radiating elements 11, 14, 19. The elements are evenly spaced at intervals d. A microwave signal for powering the antenna elements is derived from a transmitter 30. This transmitter signal is applied to a power divider 12 which distributes the input power to the radiating elements 11, 14, 19 through the phase shifters 15 with a predetermined relative amplitude.

Antenna beam steering is accomplished by electronically adjusting each of the phase shifters 15 to apply a specified phase shift to the energy passing through to its associated radiating element. The phase shifts vary with time and along the length of the array beginning at one end with antenna element 11 and ending at the other end with antenna element 19. The phase at each of n elements is given by $$\psi_n(t) = \pm 2\pi \frac{nd}{\lambda} \sin(kt)$$

+ for the TO beam, − for the FRO beam
d=element spacing
λ=free space wavelength
t=time (t=0, beam pointing at 0° direction)
k=scan rate (349.1 radians/sec)

The result is a radiating beam which scans TO and FRO from a maximum angle in one direction to a maximum angle in the other direction.

In order to monitor the performance of the phased array antenna system 10, the monitoring system 20, or at least the monitoring antenna 22, is placed so that it intercepts the beam as it is scanned TO and FRO. As shown in FIG. 1, receiving antenna 22 is located within the scanning beam coverage sector. The other portions of the monitor, i.e., signal processor 24 and monitor device 26, may be located at any convenient position.

The monitor antenna 22, instead of being located in the far field where the scanning beam is focused, is instead located in the near field. For example, if the far field is beyond approximately 1400 feet, antenna 22 can be located within a hundred feet of antenna 10. Since it is located in the near field, the signal received by antenna 22 is not focused and contains phase error. Thus, for a scanning beam the signal shown on the line just after antenna 22, is received. This signal may then be modified by a signal processor 24 to produce the wave form at its output. Basically, signal processor 24 applies a conjugate phase correction to the unfocused signal received by the antenna, so as to provide a focused signal pattern at its output which has the same shape it would have if the receiving antenna 22 were located in the far field.

Figure 2:
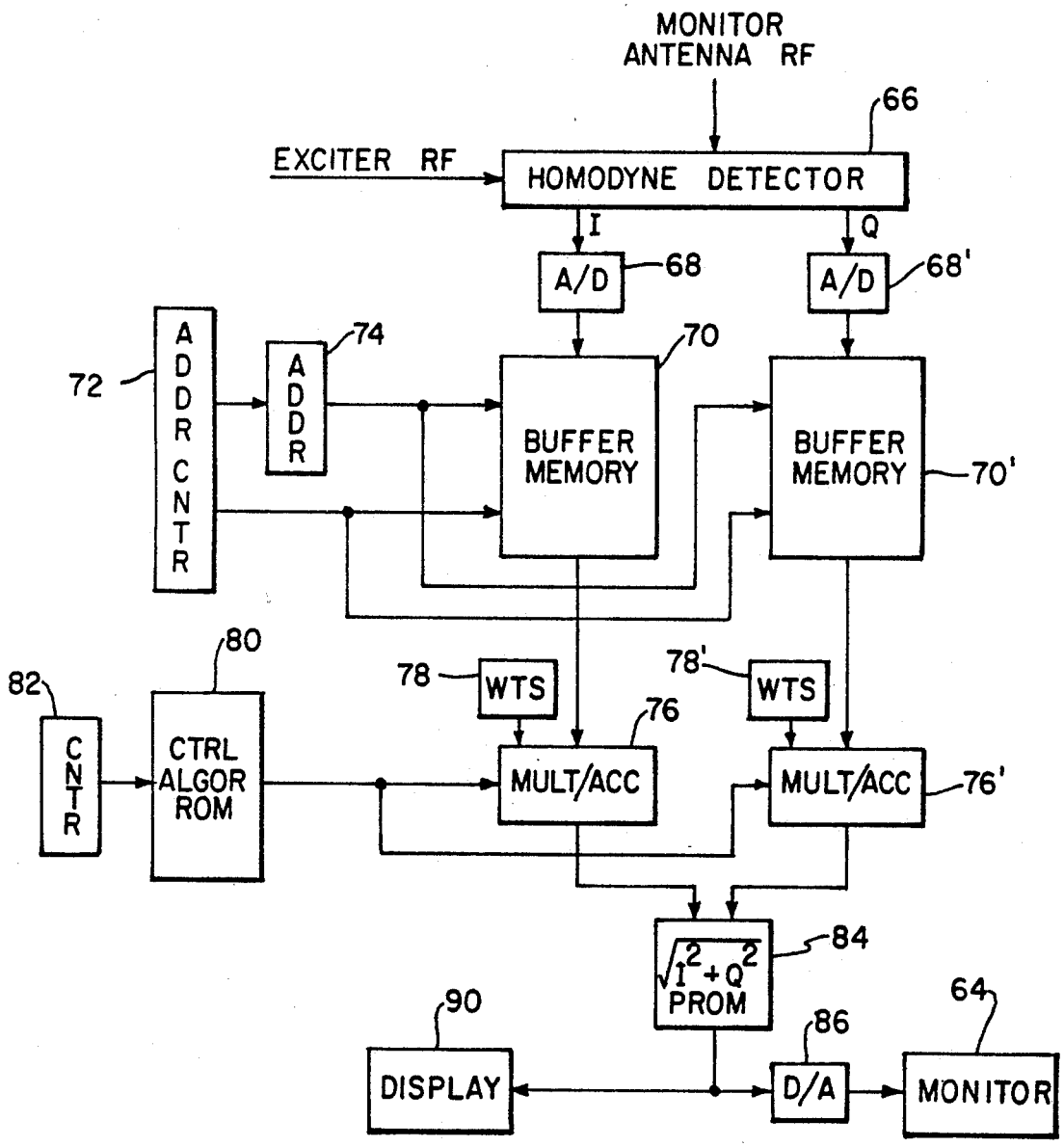
FIG. 2 PRIOR ART
FIG. 2 is a block diagram of a prior embodiment of the signal processor of FIG. 1.

FIG. 2 shows a block diagram of a prior signal processor, in particular the one disclosed in co-pending U.S. patent application Ser. No. 07/591,698, of Feldman et al. In this signal processor, the signal from monitor antenna 22 is applied to homodyne detector 66. The homodyne detector also receives as an input the exciter RF signal from the transmission system. The homodyne detector generates the in-phase ("I") and the quadrature ("Q") signals as outputs. These I,Q signals from homodyne detector 66 are converted to digital signals by analog-to-digital converters 68, 68' which produce bits of sample information every two microseconds. The data bits from the analog-to-digital converter 68, 68' are stored in buffer memories 70, 70', which may be, for example 1K by 8 bit RAMs. An adder/counter 72 and an adder 74 serve as a circulating counter to sequentially address the data bits in buffer memories 70, 70', and pass the data to multiplier/accumulators 76, 76'. In the multiplier/accumulators, the data in moving groups is sequentially multiplied by sets of weighing factors 78, 78' based on an algorithm stored in a ROM 80 and initiated by a counter 82.

The outputs from the multiplier/accumulators 76, 76' pass to a PROM 84 where they are combined according to the function shown. The output of PROM 84 passes to a digital/analog converter 86 and then to monitor 64. If desired, the digital output of PROM 84 may be fed to a digital display 90.

Figure 3:
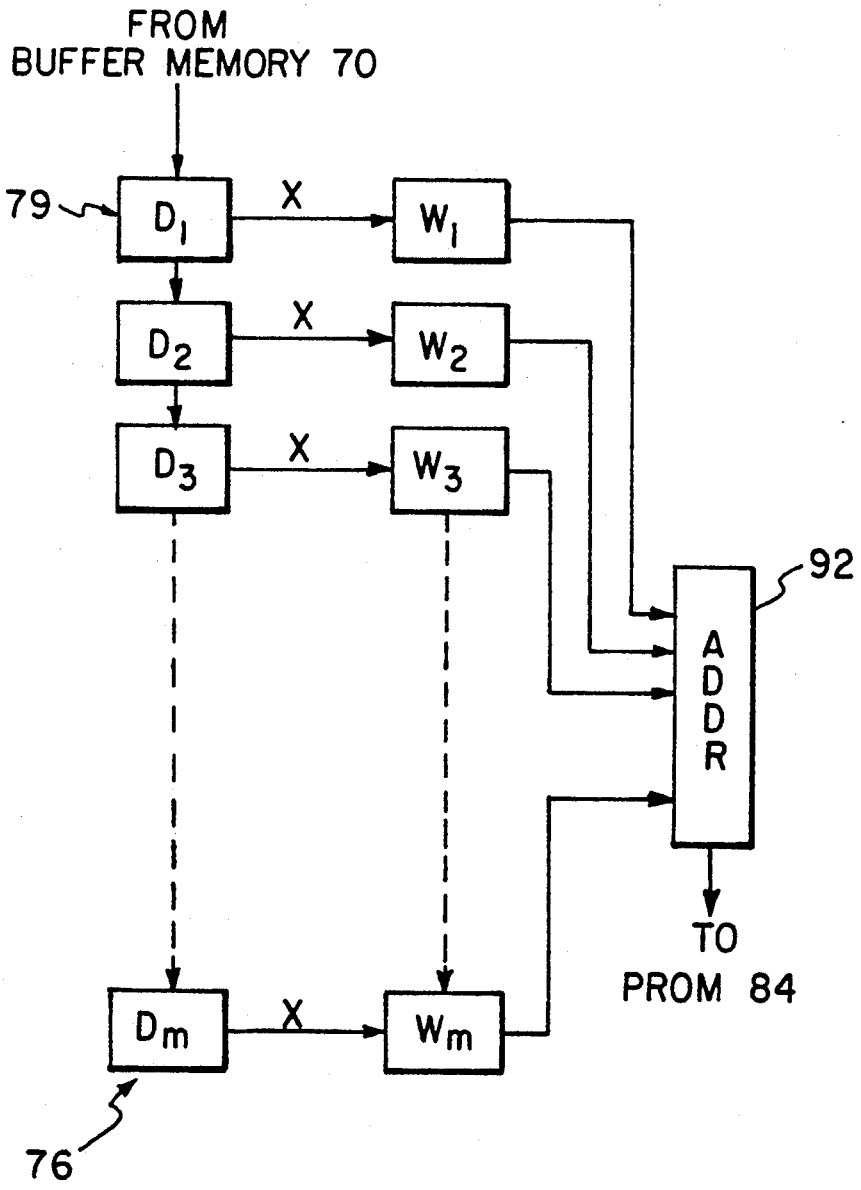
FIG. 3 PRIOR ART
FIG. 3 is a block diagram of the multiplier/accumulator circuit of the signal processor of FIG. 2.

FIG. 3 illustrates the arrangement of multiplier/accumulators 76 76' in the Feldman et al. application. As shown, a moving stream of data bits from buffer memories 70, 70' is passed through a series of elements of a shift register 79, which has elements $D_1 \ldots D_m$. Each bit is then multiplied by a weighing factor $W_1 \ldots W_m$. The results of the multiplication are accumulated in adder 92, whose output is passed to PROM 84. The weighing factors are chosen such that the final analog signal to monitor 64 (FIG. 2) will approximate that which it would receive in the far field.

Figure 7A:
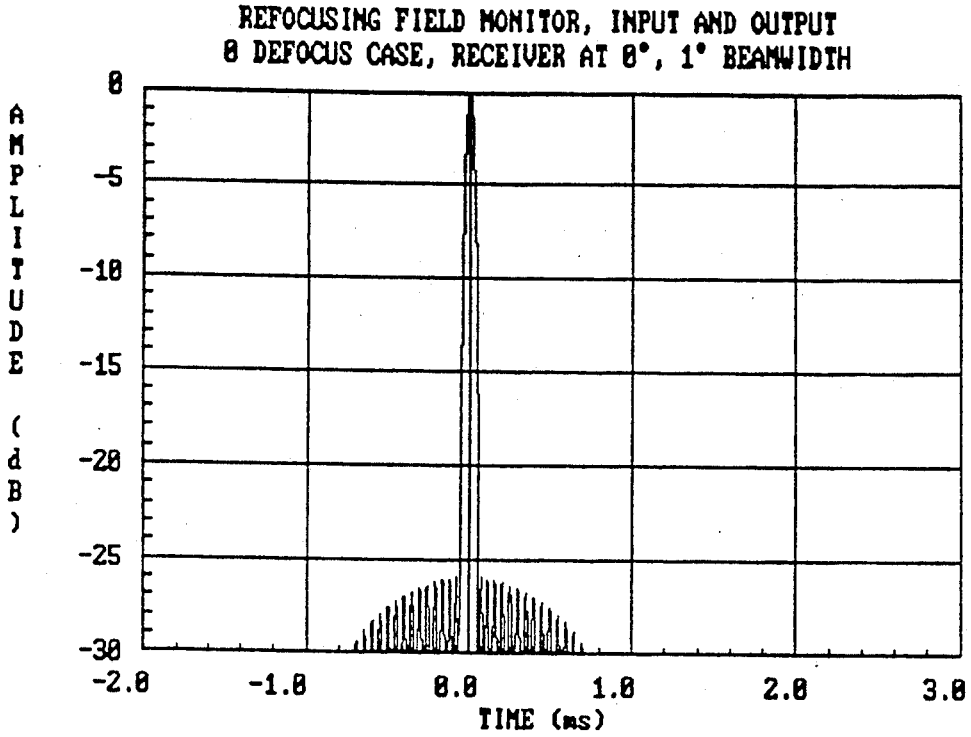
FIG. 7A shows the received signal at the far field.

With the embodiment shown in FIGS. 1–3, it is possible to obtain satisfactory results, for the case of a 1° beam width antenna with a monitor installed in the near field, at least as close to the transmitting antenna as 200 to 300 feet. It has been found, however, that with the embodiment of FIGS. 1–3, the accuracy falls off significantly as the monitoring antenna is moved to distances of 80 to 100 feet from the MLS antenna. FIG. 7A shows the shape of an ideal signal at the far field. At a distance of about 100 feet the signal degrades so it has the appearance of the signal on the left in FIG. 7B. Processing this signal according to the process disclosed in the Feldman et al. application improves the signal so that it looks like the signal to the right in FIG. 7B. While much improved it is still far from having the shape of the far field signal (FIG. 7A).

Figure 4:
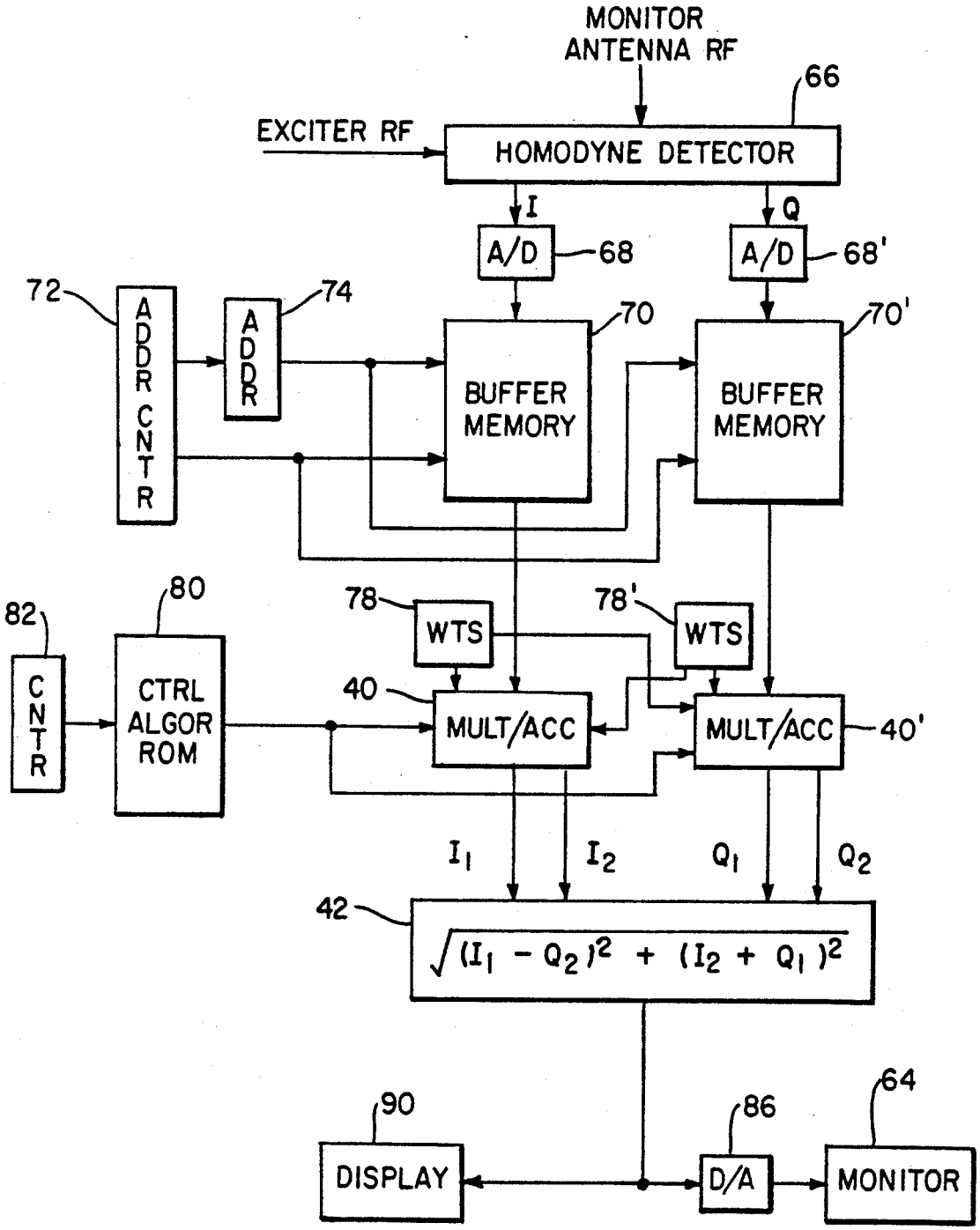
FIG. 4 is a block diagram of an embodiment of the signal processor of FIG. 1 according to the present invention.

The present inventor has discovered that the signal received at small distances, e.g. under 100 feet, can be improved significantly by processing them according to a method that takes into consideration cross factors in the equation for the signal. A circuit for accomplishing this is shown in FIG. 4. In particular, the cross factors are the weighing factor 78 multiplied with the Q output of buffer memory 70' and the weighing factor 78' multiplied by the I output from buffer memory 70.

By comparing FIGS. 2 and 4, it can be seen that in FIG. 4 new multiplier/accumulators 40, 40', which are capable of producing cross product terms, have been substituted for multiplier/accumulators 76, 76' in FIG. 2. Each of these is capable of combining one of the I or Q terms from memories 70, 70' with the WQ and WI factors to produce two outputs each, i.e.

$$I_1 = \sum_m I_m \times WI_m \; I_2 = \sum_m I_m \times WQ_m$$

$$Q_1 = \sum_m Q_m \times WI_m \; Q_2 = \sum_m Q_m \times WQ_m$$

Thus, these accumulators produce not only the direct products $I_1$, $Q_2$, but also the cross products $I_2$, $Q_1$. These factors are combined according to the equation stored in PROM 42, i.e.

$$A = \sqrt{(I_1 - Q_2)^2 + (I_2 + Q_1)^2} \tag{1}$$

In effect, by utilizing the cross product terms a more accurate duplication of an ideal digital filer is created so that the signal from processor 24 is closer to the signal that would appear at the far field. Consequently, the processor can handle monitoring antennas which are closer to the MLS antenna than in prior systems without producing excessive errors. The improvement can be seen by comparing the result of this process shown as the right signal in FIG. 7C, to both the signal of the prior process, shown at the right in FIG. 7B, and the ideal signal shown in FIG. 7A.

Figure 5:
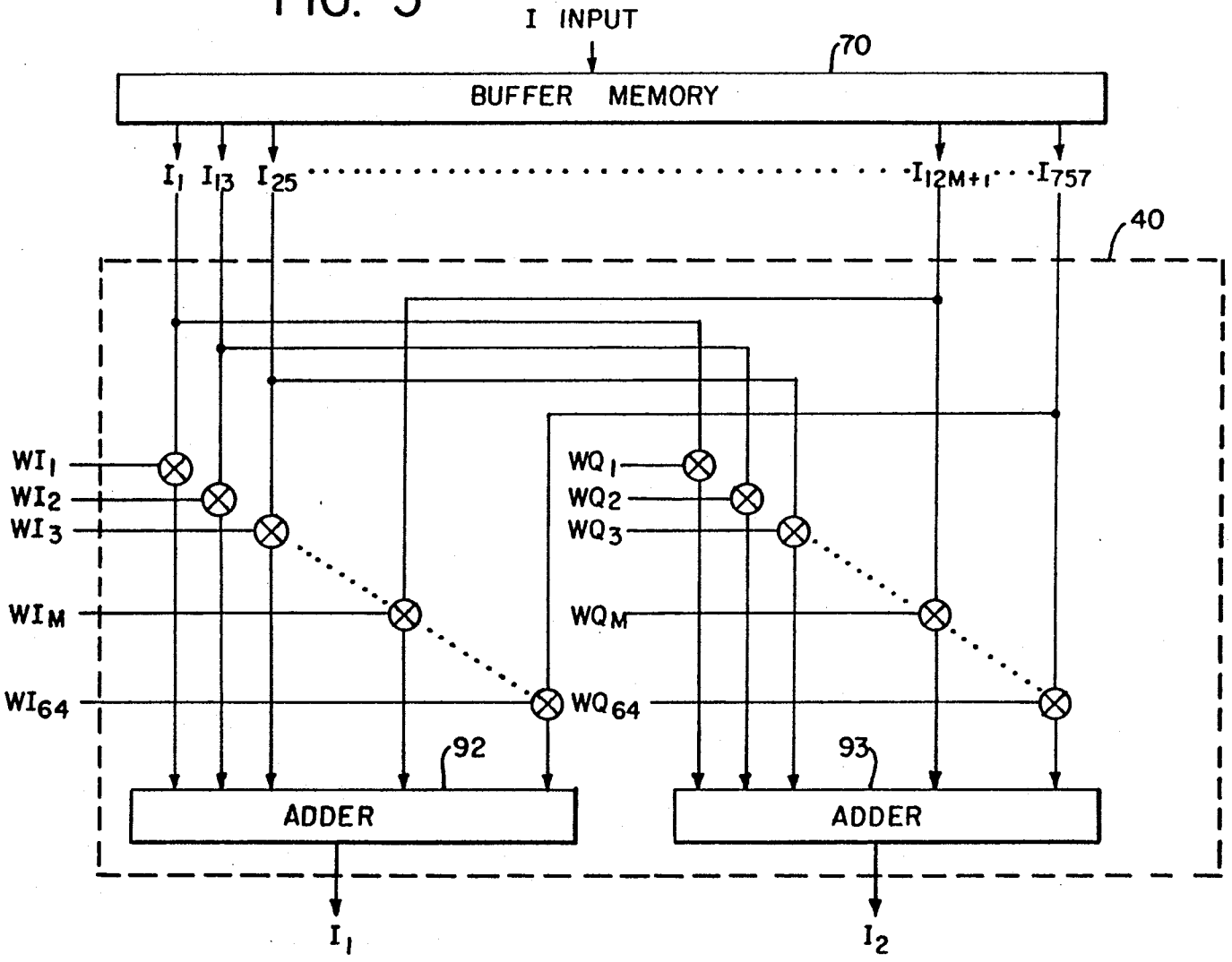
FIG. 5 is a block diagram of the multiplier/accumulator circuit of the signal processor of FIG. 4.

FIG. 5 illustrates the arrangement of multiplier/accumulator 40. As shown, a subset of the I elements in buffer memory 70 during one sample time, e.g. 2 μs, is multiplied by weighing factors $WI_m$ and $WQ_m$. The results of the multiplications are accumulated separately in adders 92 and 93 whose outputs are passed to PROM 42, FIG. 4. An identical process is performed on the Q elements.

The basis for Equation (1) and the use of the cross products in the phase conjugate processing can be derived as follows:

For the case of a continuous line source antenna along the y axis, the angle between the x axis in FIG. 1 and the center of the scanning beam is Θ, where Θ=kt and k=the scan rate (379.1/radian/sec). The line source excitation is given by $$f(y, t) = a(y) \exp(j\psi(y, t)) \tag{2}$$

$$\psi(y,t) = \frac{2\pi y}{\lambda} \sin(kt) = 2\pi f t \tag{3}$$

where $\lambda$=free space wavelength
a(y)=amplitude excitation
f=frequency $$d\psi(y,t)/dt = \frac{2\pi y}{\lambda} k \cos(kt) = 2\pi f \quad (4)$$

therefore $$f = \frac{k}{\lambda} y \cos\theta$$

This shows that there is a linear relationship between f and y over a limited scan sector.

$$f = \frac{k}{\lambda} y$$

At a particular observation point (x,y) the total field is given by $$f(y,t) = \int_{-\infty}^{\infty} a(y)\exp(j\psi(y,t))\exp\left(-j\frac{2\pi}{\lambda}(R(y) - R)\right)dy \quad (5)$$

where
R(y)=the distance from a point on the line source to the monitor antenna 22 and
R=the x coordinate of the monitor antenna 22

$$f(t) = \quad (6)$$

$$\int_{-\infty}^{\infty} a\left(\frac{f}{k}\right)\exp\left(-j\frac{2\pi}{\lambda}\left(R\left(\frac{f}{k}\right) - R\right)\right)\exp(j2\pi ft)\frac{df}{k}$$

$$f(t) = \int_{-\infty}^{+\infty} F(f)\exp(+j2\pi ft)\,df \quad (7)$$

where f(t) is the Fourier Transform of F(f).

The output of the signal processor 24 is given by:

$$g(t) = \int_{-\infty}^{+\infty} F(f)\,W(f)\exp(j2\pi ft)df \quad (8)$$

where W(f) is the compensating filter frequency response $$g(t) = \int_{-\infty}^{\infty} f(\tau)\,(t - \tau)d\tau \quad (9)$$

$$g(t) = \int_{-\infty}^{\infty} [I(\tau) + jQ(\tau)][WI(t - \tau) + jWQ(t - \tau)]d\tau \quad (10)$$

$$g(t) = I_1 - Q_2 + j(I_2 + Q_1) \quad (11)$$

where $$I_1 = \int_{-\infty}^{\infty} I(\tau)WI(t - \tau)d\tau,$$

$$I_2 = \int_{-\infty}^{\infty} I(\tau)WQ(t - \tau)d\tau$$

$$Q_2 = \int_{-\infty}^{\infty} Q(\tau)WQ(t - \tau)d\tau,$$

-continued $$Q_1 = \int_{-\infty}^{\infty} Q(\tau)WI(t - \tau)d\tau$$

$$|g(t)| = \sqrt{(I_1 - Q_2)^2 + (I_2 + Q_1)^2} \quad (12)$$

If we assume that antenna 22 is offset from antenna 14 by a distance $y_0$, then R(y) in Equation 5 above is equal to $$R(y) = \sqrt{(y - y_0)^2 + R^2} \quad (13)$$

where y is the distance along the array to the particular element and R is the x distance from the plane of the array to the plane in which the monitoring antenna 22 is located. This is the distance R(y) from a particular antenna array element to the field monitor antenna.

The refocusing near field filter frequency response is given by $$W(f) =$$

$$\left[u\left(f + \frac{kD}{\lambda}\right) - u\left(f - \frac{kD}{\lambda}\right)\right]\exp\left(j\frac{2\pi}{\lambda}(R(y) - R)\right)$$

where u(f) is the unit step function, u(f)=0 for f<0, u(f)=1 for f≧0.

The filter bandwidth, FBW, is two times the signal bandwidth (20.946 KHz). This allows sufficient bandwidth for monitoring sharp beam cutoff affects. To determine the filter weights according to the Fourier Transform of W(f) the filter window must be sampled at $y=\lambda/2$ intervals to avoid grafting or alliasing lobes. This corresponds to f=k/2 intervals.

N=The number of frequency sample points
N=smallest odd integer>$4D/\lambda$
for $D/\lambda=60$ N=241

The weights are determined according to $$W_m = WI_m + jWQ_m$$

$$W_m = \sum_{n=-(N-1)/2}^{(N-1)/2} W(nk/2)\exp\left(jn\pi k\frac{(-M + 2m - 1)}{2}T\right) \quad (14)$$

m=1 to M where M is an even integer
$\tau$=input data sampling period=2 $\mu$s.

$$T' = \frac{1}{2FBW} = \frac{1}{2}\,\frac{\lambda}{kD} = 23.82\ \mu s$$

T is the nearest integer to T' that is devisable by $\tau$
T=filter sampling period=24 $\mu$s For a 64 point convolution digital signal processor (M=64) the delay time is 768 $\mu$s and the processing time is 1536 $\mu$s. The filter delay time must be sufficient to allow for the recombination of the energy that is spread over time by the defocusing process. The 64 point convolution digital signal processor has been simulated on a computer for the case of a 1° beamwidth array antenna and the field monitor antenna at a distance of 1/12 $D^2/\lambda$ (60 feet). The $WI_m$ and $WQ_m$ weights are shown in FIG. 6.

Figure 7B:
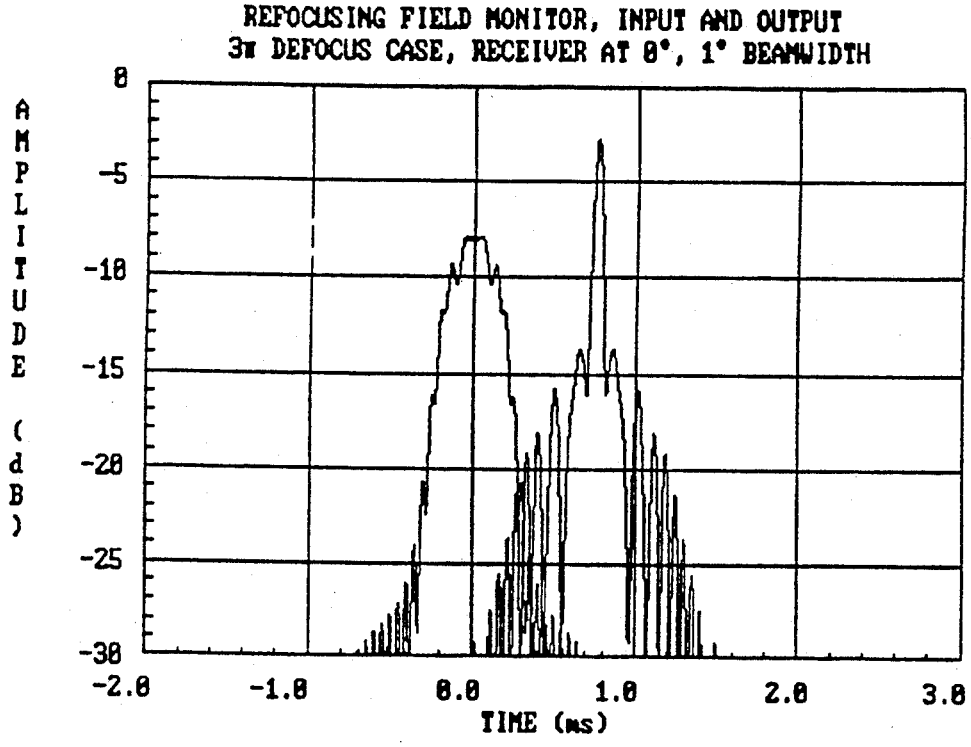
FIG. 7B illustrates the received signal in the near field on the left and after processing according to a prior technique on the right.
Figure 7C:
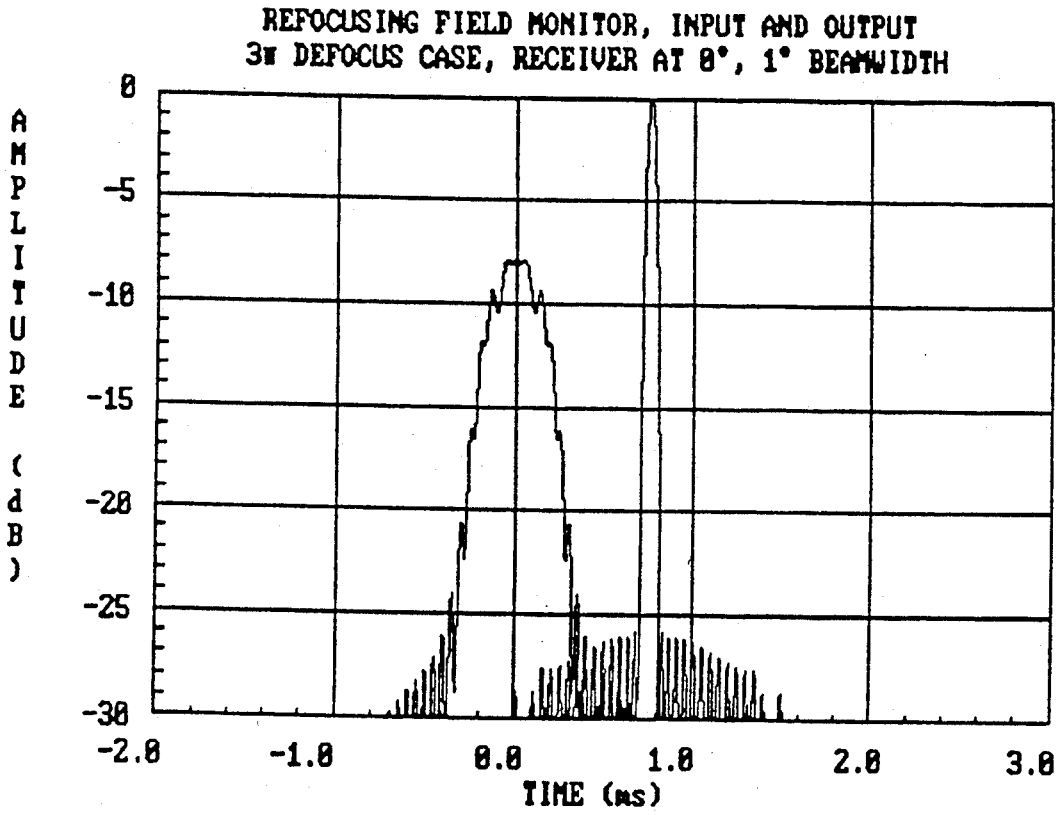
FIG. 7C shows the signal received in the near field on the left and the signal after processing according to the present invention on the right.

As noted above, the results of the computer simulation for the copending U.S. application Ser. No. 07/591,698 of Feldman et al, and this invention are shown in FIG. 7. FIG. 7A shows the far field signal. FIG. 7B shows the prior art input defocused signal and the delayed output refocused signal and FIG. 7C shows the same signals for the new embodiment. The beam shape, beam width and side lobe level, in the case of a signal processed according to the present invention is much closer to the far field beam shape.

While the present invention has been particularly shown and described with reference to preferred embodiments thereof, it will be understood by those skilled in the art that various changes in form and details may be made therein without the departing from the spirit and scope of the invention.

I claim:

1. A near field monitor for a microwave landing system antenna, comprising:

a monitor antenna located in the near field for receiving a signal transmitted by the microwave landing system which scans back and forth, i.e., TO and FRO;

converting means for converting the received signal into in-phase, I, and quadrature phase, Q, components;

weighing factor storing means for storing in-phase weighing factors WI and quadrature phase weighing factors WQ, said weighing factors being related to the correction of the received signal in the near field such that it has the form it would have had at the far field of the signal from the microwave landing system;

means for multiplying and summing the in-phase components, I, and the quadrature phase components, Q, with the in-phase weighing factors WI and with the quadrature phase weighing factors WQ to produce multiplier/accumulator output signals $I_1$, $I_2$, $Q_1$ and $Q_2$, where $I_1 = I \times WI$, $I_2 = I \times WQ$, $Q \times WI$ and $Q_2 = W \times WQ$; and calculator means for combining the multiplier/accumulator output signals according to the following equation, $$A = \sqrt{(I_1 - Q_2)^2 + (I_2 + Q_1)^2}$$

to produce the monitor signal.

2. A near field monitor as claimed in claim 1 wherein said converting means is a homodyne detector.

3. A near field monitor as claimed in claim 2 wherein said I and Q components are in analog form, and said converting means further includes first and second analog-to-digital converter means for periodically sampling said I and Q components, respectively, and converting them into digital data representing the I and Q components.

4. A near field monitor as claimed in claim 3 further including memory means for storing the digital data for the I and Q components.

5. A near field monitor as claimed in claim 4 wherein the digital data are individually multiplied with the weight factors by said multiplier, and further including control means for timing the creation of the digital data through control of the digital-to-analog converter and the multiplication of the digital data with the weighing factors according to a control algorithm.

6. A near field monitor as claimed in claim 5 wherein said control means includes a first counter means for controlling the address of the locations in said memory means where the digital data from the analog-to-digital converter are stored and the locations from which the digital data are read for application to the multiplier means.

7. A near field monitor as claimed in claim 6 wherein said control means further includes a second outer means and a second memory means, said second memory means storing a control sequence for determining when the multiplier means should operate, said second counter controlling the address in the second memory means from which the control sequence is read.

8. A near field monitor as claimed in claim 1 further including a display for displaying the monitor signal.

9. A near field monitor as claimed in claim 1 further including a digital-to-analog converter means for converting the monitor signal to an analog signal, and an analog signal monitor for determining the condition of the monitor signal.

10. A near field monitor as claimed in claim 1 wherein the microwave landing system signal is focused beyond $2D^2/\lambda$ where D is the width of a transmitting antenna array for the microwave landing system and $\lambda$ is the wavelength of the signal; and wherein said monitor antenna is located within $\frac{1}{3}$ $D^2/\lambda$ of the transmitting antenna array.

11. A near field monitor as claimed in claim 10 wherein the monitor antenna is located within 1/10 $D^2/\lambda$ of the transmitting antenna.

* * * * *